US006789601B2

(12) United States Patent
Rooth

(10) Patent No.: US 6,789,601 B2
(45) Date of Patent: Sep. 14, 2004

(54) SCREEN DOOR WITH CHILD-ACCESSIBLE HANDLE

(76) Inventor: Sarah Rooth, 814 Timber Hill Rd., Highland Park, IL (US) 60035

( * ) Notice: Subject to any disclaimer, the term of this patent is extended or adjusted under 35 U.S.C. 154(b) by 0 days.

(21) Appl. No.: 10/318,635

(22) Filed: Dec. 13, 2002

(65) Prior Publication Data

US 2004/0112552 A1 Jun. 17, 2004

(51) Int. Cl.[7] ..... A47G 5/00

(52) U.S. Cl. ..... 160/371; 160/380; 160/403; 49/460

(58) Field of Search ..... 160/89, 90, 91, 160/371, 380, 403; 49/460

(56) References Cited

U.S. PATENT DOCUMENTS

| | | | | | |
|---|---|---|---|---|---|
| 3,308,875 | A | | 3/1967 | Abrams | |
| 3,391,674 | A | | 7/1968 | Burleigh | |
| 3,838,539 | A | * | 10/1974 | Gronowicz | 49/462 |
| 4,284,299 | A | * | 8/1981 | Kelly | 292/87 |
| 4,480,862 | A | * | 11/1984 | Fleming | 292/162 |
| 4,686,742 | A | | 8/1987 | Arnold | |
| 4,788,745 | A | | 12/1988 | Wallis et al. | |
| 5,048,587 | A | * | 9/1991 | York | 160/217 |
| 5,152,561 | A | * | 10/1992 | Engebretson | 292/145 |
| 5,379,821 | A | | 1/1995 | Pergolizzi et al. | |
| 5,659,999 | A | * | 8/1997 | Benson | 49/404 |
| 5,730,196 | A | | 3/1998 | Frament | |
| 5,740,849 | A | * | 4/1998 | Tashman | 160/102 |
| 6,067,690 | A | | 5/2000 | Herman | |
| 6,135,513 | A | * | 10/2000 | Hamada et al. | 292/201 |
| 6,532,703 | B1 | * | 3/2003 | Barrens | 52/202 |
| 6,629,555 | B2 | * | 10/2003 | DeBlock et al. | 160/31 |
| 2002/0129554 | A1 | * | 9/2002 | van Leeuwen | 49/197 |

* cited by examiner

*Primary Examiner*—Bruce A. Lev
(74) *Attorney, Agent, or Firm*—Greer, Burns & Crain, Ltd.

(57) ABSTRACT

A sliding screen door for facilitating access through an entryway by a child includes a frame and a screen mounted to the frame. In addition, an adult height handle having a bottom edge is mounted on the frame at a first height from a floor adjacent the door, and a child height handle is mounted on the frame at a height below the bottom edge of the adult height handle. It is also contemplated that the two handles can be combined into a single elongate handle. This ensures that a child, who cannot reach the adult height handle, has access to a door handle for opening and closing the sliding screen door.

13 Claims, 2 Drawing Sheets

SCREEN DOOR WITH CHILD-ACCESSIBLE HANDLE

BACKGROUND OF THE INVENTION

The present invention relates to screen doors such as sliding patio-type screen doors, and specifically to such a door featuring improvements for facilitating use of the door by young children.

Screen doors, such as sliding patio-type screen doors are known to include a handle on at least one or both of an outer and inner surface for opening and closing the door relative to the surrounding entryway. This handle is typically located at a height which may be out of the reach of a small child such as a toddler. This situation creates problems for both the child and the working condition of the sliding screen door. The child may try to extend his or her body to reach a typical handle by standing on the tops of his toes or increase his or her height by grabbing the screen, stepping on the frame of the screen door, or standing on the nearest object, which looks like it can be supportive. Here, the child encounters obvious risks for injury through unstable support. In other instances, the child may merely push on the screen cloth. Further, through treatment such as this, the working condition of the sliding screen door can quickly deteriorate. Alternatively, the child may simply require assistance from an adult or taller child in moving through an entryway sliding screen door, because the child cannot open the door. Likewise, the child cannot independently close the door, leaving the interior accessible for unwanted insects, etc.

Alternative devices have been devised for opening and closing doors, however, none considers the problems discloses above or provides a way for a child to open or close a sliding screen door, and, thus, enable independent access to an entryway for a child. In U.S. Pat. No. 6,067,690, a device is disclosed that is attached to the bottom of a sliding screen door for opening the door with a foot. While this device may be reachable by a child, it is not constructed or arranged for enabling the child to independently open and close a sliding screen door, nor does it address this problem. Instead, through its configuration this reference actually creates gripping and other problems for a child trying to open or close a sliding screen door. For instance, the handle may not be recognized as a handle by a child, because it is positioned so low on the door and it does not appear like a handle.

U.S. Pat. No. 3,391,674 also discloses an alternative door handle, however, this handle is mounted on a spring-closing or gravity-closing door for use by a dog or other animal. This reference also fails to teach a handle for a sliding door or, more specifically, a handle placed at a prescribed height so as to be accessible by a child.

Another problem with screen doors is the fact that in some cases, children do not recognize the presence of a screen door and run into or through it causing injury to the child and/or damage to the door. Additionally, it is often difficult for adults to determine when a screen door is closed because of lighting, the transparency of the screen cloth, etc.

U.S. Pat. Nos. 3,308,875 and 5,730,196 teach panels or ornaments that can be attached to a screen portion of a screen door to decorate the screen portion and have other aesthetic purposes, such as covering holes in the screen cloth, or providing privacy. However, these references do not address the lack of airflow or ventilation through the panels.

Thus, there is a need for providing a screen door which addresses and resolves the issues identified above.

BRIEF SUMMARY OF THE INVENTION

The above-listed goals are met or exceeded by the present screen door having an additional door handle, below a conventional screen door handle, which will facilitate and enable children during opening and closing of a screen door. This additional handle is more readily accessible for the child during opening and closing of the screen door. An additional feature of the present invention is an appliqué placed on a screen of the screen door at a child's-eye level may provide a visual indication of the position of the screen door and indicate to a child a relative position of the screen door, and in particular whether it is closed.

More specifically, a screen door for facilitating access through an entryway by a child includes a frame, a screen mounted to the frame, at least one adult height handle mounted on the frame at a first height from a floor adjacent to the entryway; and at least one child height handle mounted on the frame at a height below the adult height handle so that a child who cannot reach the adult height handle can reach and open and close the screen door. In another embodiment, a sliding screen door is provided as described above and further including a flow-through appliqué applied to the screen for warning purposes. In yet another embodiment, an extended door handle accessible by both a child and an adult is formed as a single unit.

DETAILED DESCRIPTION OF THE INVENTION

Figure 1:
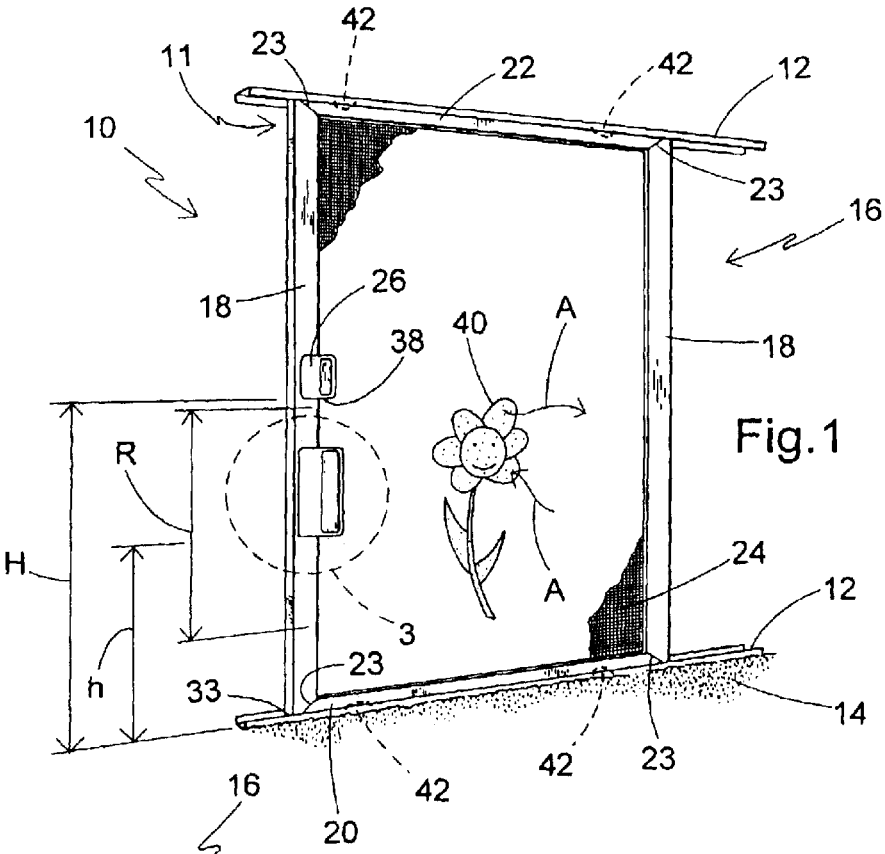
FIG. 1 is a perspective view of a screen door in accordance with one embodiment of the present invention.

Referring now to FIG. 1, the present child accessible screen door is generally designated 10. While disclosed as a sliding screen door, it is contemplated that the present door 10 may be any type of screen door, including hinged or swinging screen doors. The sliding screen door 10 is configured for mounting in an entryway 11 to provide access between an interior and exterior of a home or other building (not shown), while ventilating or exposing the interior climate to outdoor air. As is well known in the art, the sliding screen door 10 moves laterally and reciprocally within the entryway 11, and specifically, between an upper and lower members defining a track 12, the bottom track being on or adjacent to a floor 14. The exact dimensions and configuration of the track 12 may vary to suit the application, and it is contemplated that one of ordinary skill in the art may apply other ways of mounting the sliding screen door 10 within an entryway 11 even without an upper and lower track system.

The sliding screen door 10 includes a frame 16 having a pair of spaced, parallel, vertical sections 18, a bottom section 20, and a top section 22. All of the sections 18, 20, 22 are joined at corners 23 as is known in the art. A piece of screen cloth 24 is mounted to the frame 16 in one of a variety of known procedures, such as pressing the screen cloth into a groove and holding it there with a resilient bead, chemical adhesive attachment, staples or other fasteners, or other mounting technologies commonly used with screen doors, as will be appreciated by one of ordinary skill in the art. It is contemplated that any commonly used material may be utilized as the screen cloth 24, including, but not limited to metal and plastic screen materials.

Figure 2:
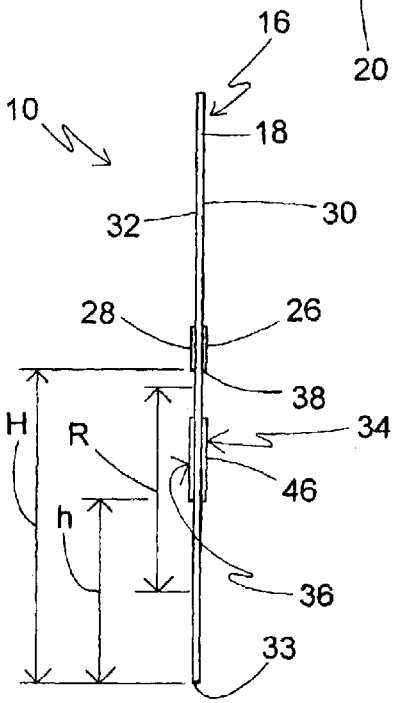
FIG. 2 is an end view of the screen door of FIG. 1.

Referring now to FIGS. 1 and 2, in a preferred embodiment, the sliding screen door 10 includes inner and outer first or adult height handles 26,28, which are mounted at a first height 'H', respectively, on an inside surface 30 and an outside surface 32 of one of the vertical sections 18 of the frame 16, as shown in FIGS. 1 and 2. The adult height handles 26, 28 are generally flush with the vertical frame section 18, are preferably of the finger pull type, and are preferably disposed to be within the reach of an arm of an adult, for ready access, regardless of whether the handles are on the inside or outside surfaces 30, 32 of the door. The typical height of a handle is set by industry standards or local codes, and varies between about 36 and 42 inches from a bottom 33 of the door 10. The door 10 is manipulated by grasping the handle 26 or 28 and pulling (or pushing) in a lateral direction. Nevertheless, the height of the adult height handles 26, 28 is characterized by being out of reach for a small child's arm or hand, or at a minimum inconveniently positioned at a height for a child in relation to the positioning of an adult height handle for an adult.

In the preferred embodiment, at least one and preferably two second or child height handles 34, 36 are mounted at a second height "h" on at least one and preferably both of the inside and outside surfaces 30, 32 of one of the vertical section 18 of the frame 16. The second height h is preferably in a range R between about one inch below a bottom edge 38 of one of the adult height handles 26, 28, and twelve inches above the floor 14. The child height handles 34, 36 thereby enable a young child incapable of reaching the adult handles to open or close the sliding screen door 10.

Providing an accessible way for a child to move the screen door 10, the present child height handles 34, 36 prevent the child from forcing his or her way through the screen door, potentially damaging the screen cloth 24 and causing injury to the child. The child height handles 34, 36 provide the child with a reachable part of the sliding screen door 10, which is intended for a child being able to move the door in a facile manner, instead of the child being forced to pull or push on other, more fragile parts of the sliding screen door, such as the screen cloth 24. Also, the child need not extend in an awkward position to grasp the adult height handle, such as standing on his or her toes or possibly standing on the nearest object for support, which may be unstable and place the child at risk of injury.

Also shown in FIG. 1 is a flow-through indicator or appliqué 40, which can be painted on the screen cloth 24 or provided as a separate layer of plastic, durable paper or similar porous, opaque and weather resistant material. Besides painting, the appliqué 40 may be attached to the door 10 in other ways, such as silk screening or, in the case of more rigid appliqués, clips or other fasteners may be used, as are known in the art. The appliqué 40 is attached to the screen cloth 24 so that air "A" can flow through it to ventilate the interior of the house and let outside air flow into the interior through the sliding screen door 10, without substantially impeding airflow. In the preferred embodiment, the appliqué 40 is applied at a height between about 1 and 5 feet above the floor 14, so that a child is provided with a visual indication and notices that the screen door 10 is in a closed position (not shown), or a partially closed position as illustrated in FIG. 1. As a visual identifier, the appliqué 40 minimizes the possibility that a child collides with the screen door 10 causing injury to the child and damage to the screen door.

As is typical in such doors 10, at least one roller 42 (shown hidden) is located along at least the bottom section 20 and preferably along the top section 22 as well. The purpose of the rollers 42 is to reduce friction between the sliding screen door 10 and the track 12, thus helping to reduce the effort required during opening or closing of the screen door. A person with ordinary skill in the art will appreciate that other devices for accomplishing this function may be substituted for the rollers 42.

Figure 3:
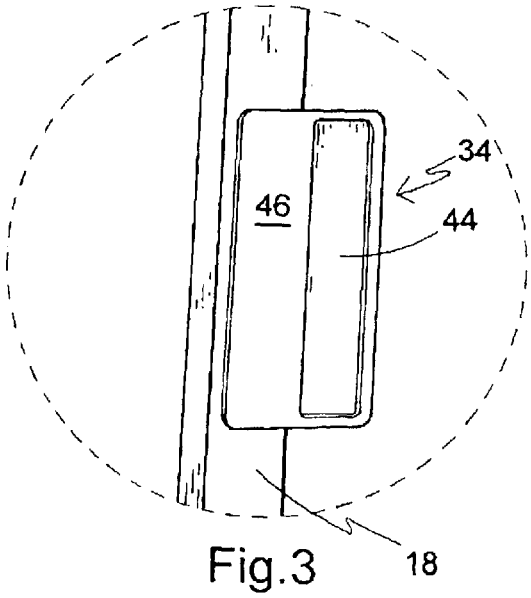
FIG. 3 is a perspective view of the child accessible handle of the screen door of FIG. 1.

Referring now to FIG. 3, one of the handles 34, 36 is depicted in greater detail. While the exact configuration of the handle 34, 36 may vary to suit the application, it is contemplated that the handle will include a grip portion 44 configured to accommodate at least a child's grip, and an attachment portion 46. In the preferred embodiment, the door 10 is a laterally sliding screen door, and the handles 34, 36 in general, and the grip portion 44 specifically are constructed and arranged for exerting a lateral force on the door to provide the required lateral sliding action. In the depicted embodiment, the grip portion 44 is a recessed panel with a concave shape. However, the configuration of the grip portion 44 and the configuration of the attachment portion 46 may vary to suit the application. Preferably, the grip portion 44 is larger than the corresponding grip portion of an adult handle, such as the handle 26. The attachment portion 46 is secured to the vertical section 18 of the frame 16 by chemical adhesion, threaded fasteners, rivets, clips, or other ways known in the art.

Figure 4:
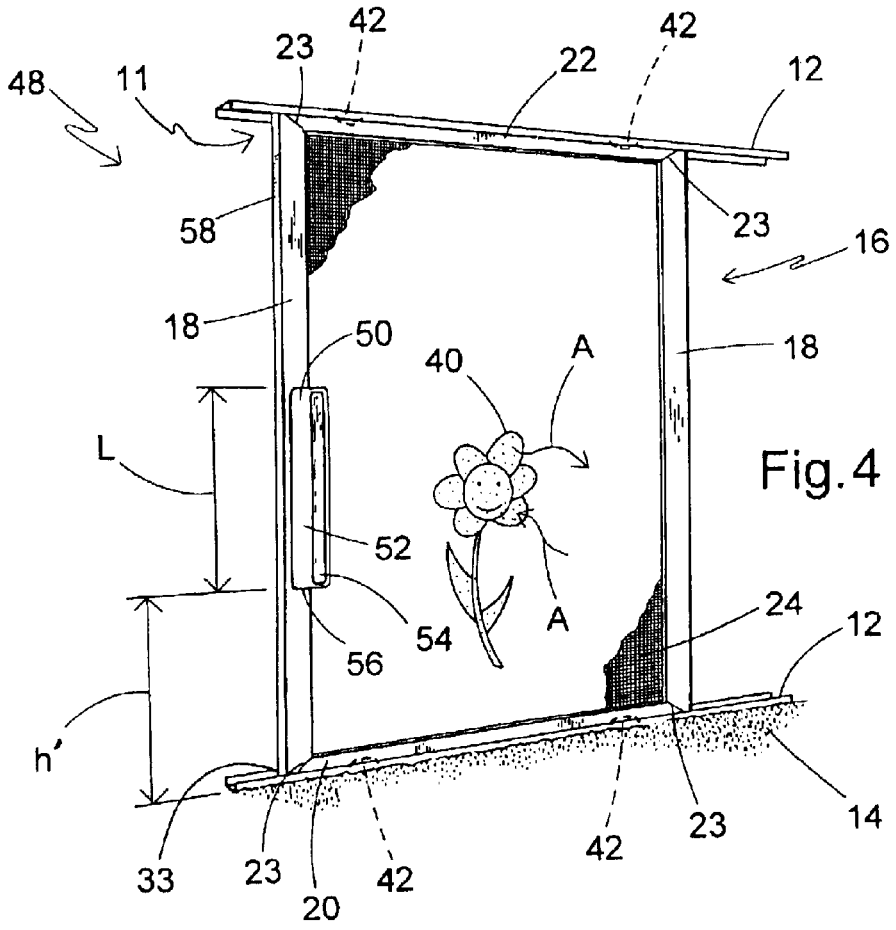
FIG. 4 is a perspective view of a screen door in accordance with an alternative embodiment of the present invention.

Referring now to FIG. 4, an alternative embodiment of a child accessible screen door is generally designated 48. The screen door is similar to the screen door 10, and includes shared components that are designated with identical reference numbers. For example, the screen door 48 is configured for mounting in the entryway 11 to provide access between the interior and exterior of a home or other building, while ventilating the home. The screen door 48 has rollers 42 connected to the bottom section 20 and the top section 22, which are guided by the track 12 that guides lateral movement of the screen door 48. It is contemplated that the screen door 48 incorporates many of the features of the screen door 10 in any particular application. One additional feature of the screen door 48 is that the adult and child height handles 26, 34 respectfully, are combined as a single handle 50. The handle 50 may vary in size to suit the application, and it is contemplated that the handle will include an attachment portion 52 and a grip recessed portion 54.

In the preferred embodiment, the door 48 is a laterally sliding screen door, and the handle 50 has a length "L" of approximately 18 inches and has a bottom 56 which is positioned at a height h' that is approximately 23 inches from the bottom 33 of the door 48. The increased length "L" of the handle 50 versus a shorter conventional handle is configured to facilitate a child's grip, especially when the child uses two hands. It is envisioned that the length and position of the handle 50 can be modified to suit specific user needs. By way of example, the handle 50 can have the length "L" extending along the entire vertical section 18. As will be appreciated by those skilled in the art, the exact design of the handle 50, including the attachment portion 52 and the grip recessed portion 54 are variable. However, it is preferred that the attachment portion 52 and the recessed gripping portion 54 extend virtually the full length of the handle 50. It is also contemplated that a second handle, similar to the handle 50, can be positioned on an opposing exterior surface 58 of the door 48 to open the door when inside a house or other structure. Moreover, although a generally flat handle 50 is illustrated, similar to the handles 26 and 34, a flip-type handle that can close (e.g., by user interaction) to a generally flat shape adjacent the door 48, similar to the handle 50, may be suitably implemented with the present invention.

While a particular embodiment of the screen door with child accessible handle has been described herein, it will be appreciated by those skilled in the art that changes and modifications may be made thereto without departing from the invention in its broader aspects and as set forth in the following claims.

What is claimed is:

1. A screen door for facilitating access through an entryway by a child comprising:

a frame having a bottom section;

a screen mounted to said frame;

at least one first handle mounted on said frame at a first height from said bottom section of said frame;

at least one second handle separately mounted on said frame at a second height below said first handle so that the child can reach at least one of said first and second handles and at least one of open and close the screen door; and said at least one second handle having a second handle grip portion larger than a grip portion of said at least one first handle.

2. The screen door as recited in claim 1, wherein said at least one second handle is mounted at a height between 12 inches above a bottom of the screen door and 1 inch below a bottom edge of said at least one first handle.

3. The screen door as recited in claim 1, wherein said at least one second handle is mounted at a height between 18 inches above a bottom of the screen door and 4 inches below a bottom edge of said at least one first handle.

4. The screen door as recited in claim 1, further comprising two of said at least one second handle, one of which is mounted on an inside surface of said frame and the other of which is mounted on an outside surface of said frame.

5. The screen door as recited in claim 1, further comprising two of said at least one first handle one of which is mounted on an inside surface of said frame and the other of which is mounted on an outside surface of said frame.

6. The screen door as recited in claim 1, further comprising a separate air flow-through indicator attachable to said screen for providing a visual indication of the position of said screen.

7. The screen door as recited in claim 6, wherein said indicator is applied to said screen between 1 and 3 feet above a bottom of said frame and allows air to flow therethrough.

8. The screen door of claim 1, wherein said screen door is laterally slidable along a bottom section of said frame and said at least one second handle is constructed and arranged for exerting a lateral force on said screen door.

9. A screen door for facilitating access by a child through an entryway being adjacent a floor while alerting the child of the position of the screen door to prevent the child from running therethrough, the screen door comprising:

a frame having a bottom section;

a screen mounted to said frame;

at least one first handle configured to be secured to said frame at a first height relative to said bottom section;

at least one second handle configured to be separately secured to said frame at a height between 12 inches above said lower end and 1 inch below a bottom edge of said at least one first handle; and a separate air flow-through indicator attachable to said screen for providing a visual indication of the position of said screen.

10. The screen door as recited in claim 9, further comprising two of said at least one second handle, one of which is mounted on an inside surface of said frame and the other of which is mounted on an outside surface of said frame.

11. The screen door of claim 9 wherein said screen door is laterally slidable along the bottom section of said frame and said at least one second handle is constructed and arranged for exerting a lateral force on said screen door.

12. A sliding screen door for facilitating access by a child through an entryway adjacent a floor, which alerts the child of the position of the screen door to prevent the child from running therethrough, the sliding screen door comprising:

a frame having a pair of spaced vertical sections, a bottom section, and a top section, said sections being joined at corresponding corners;

a screen mounted to said frame;

at least one first handle mounted on said frame at a first height from said bottom section of said frame;

at least one second handle mounted separately on said frame at a second height below said first handle so that the child can reach at least one of the first and second handles and at least one of open and close the screen door, and wherein said at least one second handle is mounted at a height between 18 inches above a bottom of the screen door and 4 inches below a bottom edge of said at least one first handle.

13. The screen door of claim 12, wherein said at least one second handle has a second handle grip portion larger than a grip portion of said at least one first handle.

* * * * *